United States Patent [19]

Hesch et al.

[11] 4,363,578

[45] Dec. 14, 1982

[54] CUSHIONED LOW PROFILE TRAILER

[75] Inventors: Harold Hesch, St. John, Ind.; Michael DiLuigi, Burnham, Ill.; Thomas Lindauer, Schererville, Ind.

[73] Assignee: Pullman Incorporated, Chicago, Ill.

[21] Appl. No.: 215,970

[22] Filed: Dec. 12, 1980

[51] Int. Cl.[3] ..... B62D 53/008

[52] U.S. Cl. ..... 410/56; 267/153

[58] Field of Search ..... 410/56, 57, 58, 59, 410/60, 61, 62, 63, 64, 65, 86, 87, 88; 248/352; 267/136, 140, 151-153, 140.3-140.5

[56] References Cited

U.S. PATENT DOCUMENTS

| | | | |
|---|---|---|---|
| 2,818,033 | 12/1957 | Gutridge et al. | 410/57 |
| 2,880,681 | 4/1959 | Markestein et al. | 410/62 |
| 2,936,983 | 5/1960 | Markestein et al. | 410/64 |
| 3,346,224 | 10/1967 | Rollins | 410/64 |
| 3,353,505 | 11/1967 | Rollins et al. | 410/59 |
| 3,434,683 | 3/1969 | Rollins | 410/62 |
| 3,479,969 | 11/1969 | Hammonds | 410/62 |
| 3,512,739 | 5/1970 | Powell et al. | 410/63 |
| 3,539,141 | 11/1970 | Mowatt-Larssen | 410/64 |
| 3,606,219 | 9/1971 | Hammonds et al. | 410/63 |
| 4,002,316 | 1/1977 | Parchmont | 410/63 |
| 4,095,766 | 6/1978 | Hicks, Jr. et al. | 410/63 |

*Primary Examiner*—Joseph F. Peters, Jr.
*Assistant Examiner*—M. J. Hill
*Attorney, Agent, or Firm*—Richard J. Myers

[57] ABSTRACT

A trailer hitch for supporting wheeled trailers includes a pedestal which is rigidly secured to a platform and has mounted thereon for pivotal movement vertical support members which support a fifth wheel plate. The support members are interconnected by a horizontal plate which includes a horizontal pivot shaft and cushioning members which are placed in shear during transport of the wheeled trailers from one area to another.

10 Claims, 6 Drawing Figures

CUSHIONED LOW PROFILE TRAILER

BACKGROUND OF THE INVENTION

1. Field of Invention

The invention relates to trailer hitches of the type which include a fifth wheel plate and serve to support over-the-highway freight trailers on railroad flat cars, barges, ships or in storage yards when the trailer in detached from the highway tractor.

2. Description of the Prior Art

In the prior art U.S. Pat. No. 3,434,683 issued Mar. 25, 1969 a trailer hitch is disclosed wherein a vertical pedestal pivotally supports a pair of support members which have mounted thereon a fifth wheel plate, the support members having lower portions which are cushioned by means of a cushioning device secured to a stationary platform. The present invention includes an improved construction which sharply distinguishes therefrom in that it contains improved cushioning means and associated hitch structure.

SUMMARY OF THE INVENTION

The trailer hitch of the present invention comprises a pedestal which is rigidly attached to a suitable platform, forming part of a storage area, or a transportation device. The pedestal includes spaced upright plates of triangularly shaped construction having at their upper ends pivot elements to which are connected vertically extending spaced-apart support members to which a fifth wheel plate is pivotally connected. The fifth wheel plate may be of conventional construction including a gathering jaw which will receive and contain the king pin of an over-the-highway trailer. A vertical L-shaped plate is suitably welded to the support members to retain them in laterally spaced relation. A horizontal plate or shoe includes a pair of laterally spaced upwardly extending end flanges which are pivotally connected to the support members at their lower ends by means of a transversely extending shaft which is held against rotation by a bracket welded to the shoe.

The cushioning structure includes a centrally portioned plate which is rigidly secured to the platform between the pedestal members. A pair of vertical plates are connected to the shoe and project downwardly on appropriate sides of the centrally positioned plate. Four cushion members are suitably connected to the plates. Each cushion member includes a rectangularly shaped biscuit-like rubber or resilient member which is suitably bonded to shear plates. The shear plates in turn are secured to the pedestal plates, to the vertical plates of the shoe, and to the centrally positioned anchoring plate on the platform. As the fifth wheel plate thus is moved by shock forces and the support members are pivoted the cushioning biscuit cushion the shock forces which may be encountered.

BRIEF DESCRIPTION OF THE DRAWINGS

FIG. 3 is an end elevational view of the hitch;

DESCRIPTION OF THE PREFERRED EMBODIMENT

Figure 4:
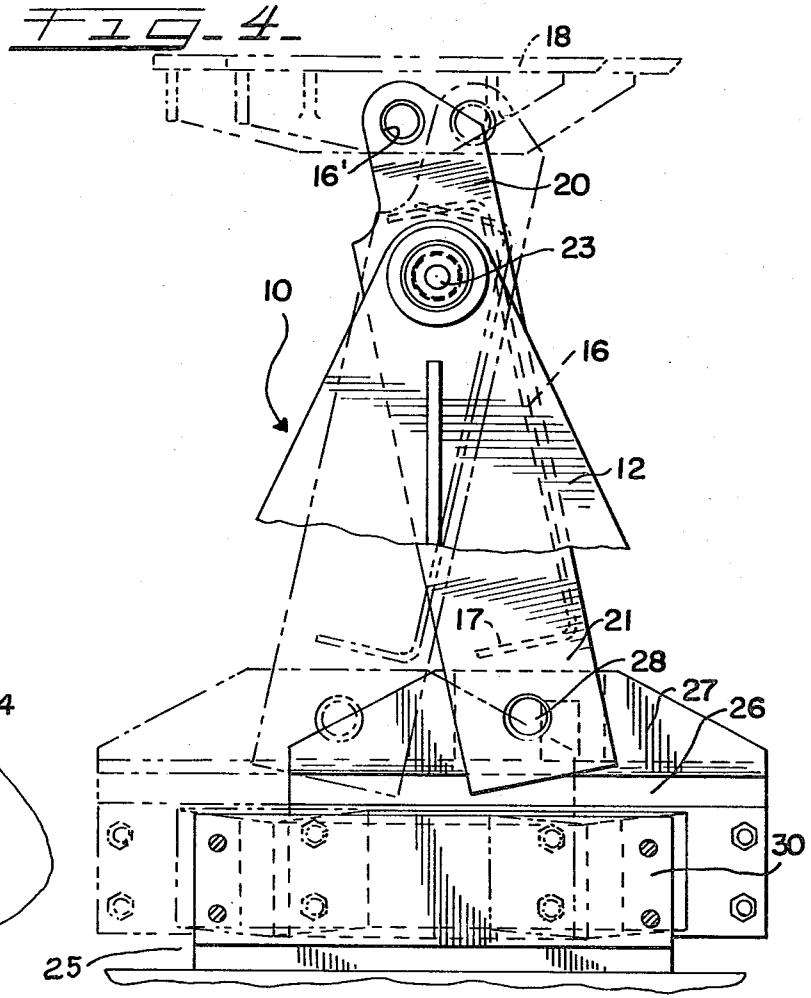
FIG. 4 is a side elevational view, partially broken away, of the hitch disclosing a cushioning function.
Figure 1:
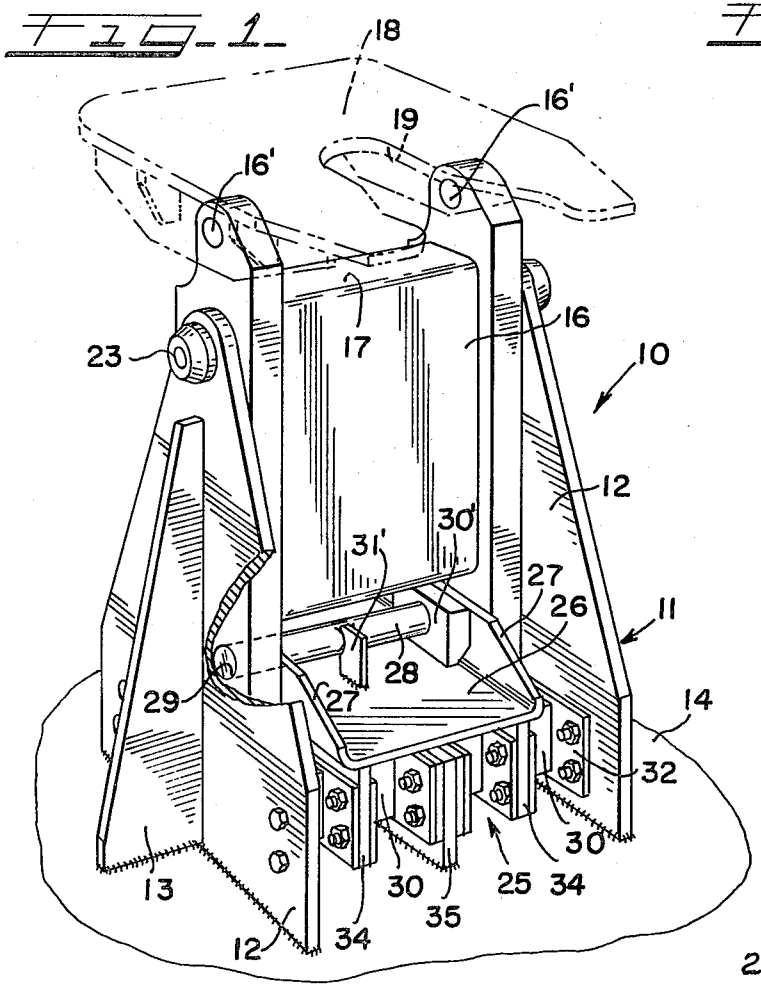
FIG. 1 is a perspective view of a trailer hitch to which a fifth wheel plate is connected.
Figure 5:
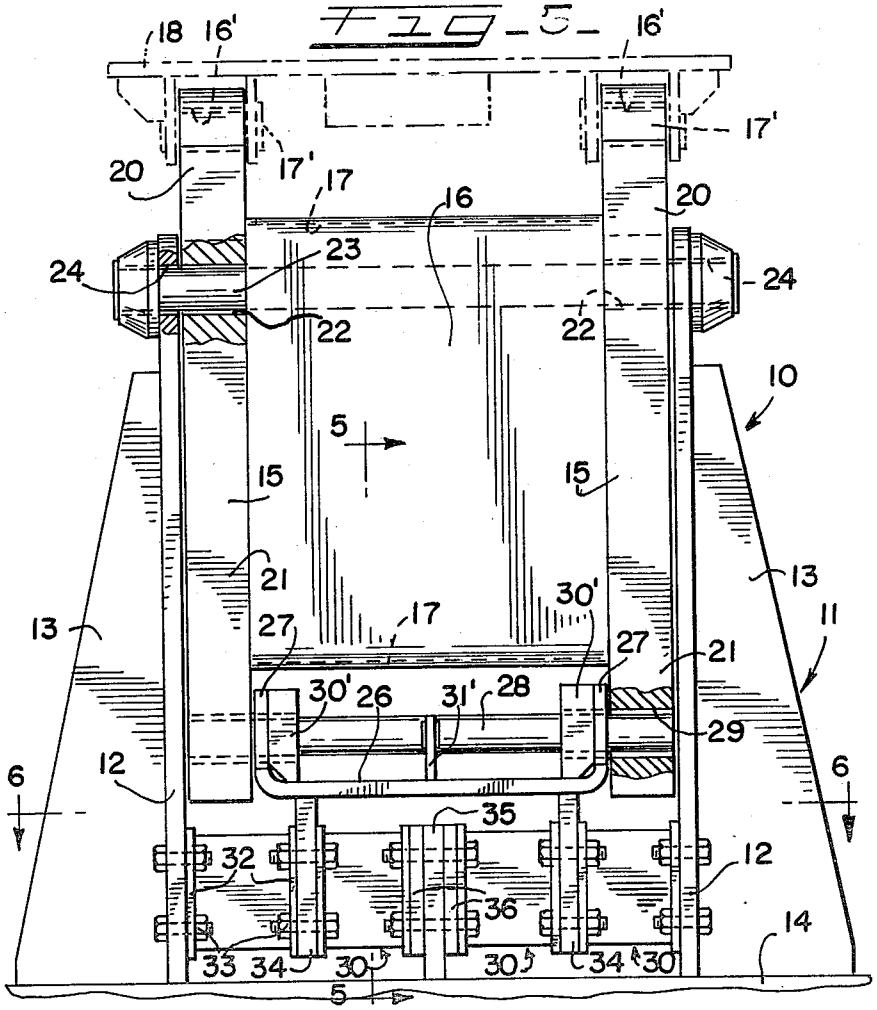
FIG. 5 is a cross sectional view taken substantially along the line 5—5 of FIG. 3.
Figure 2:
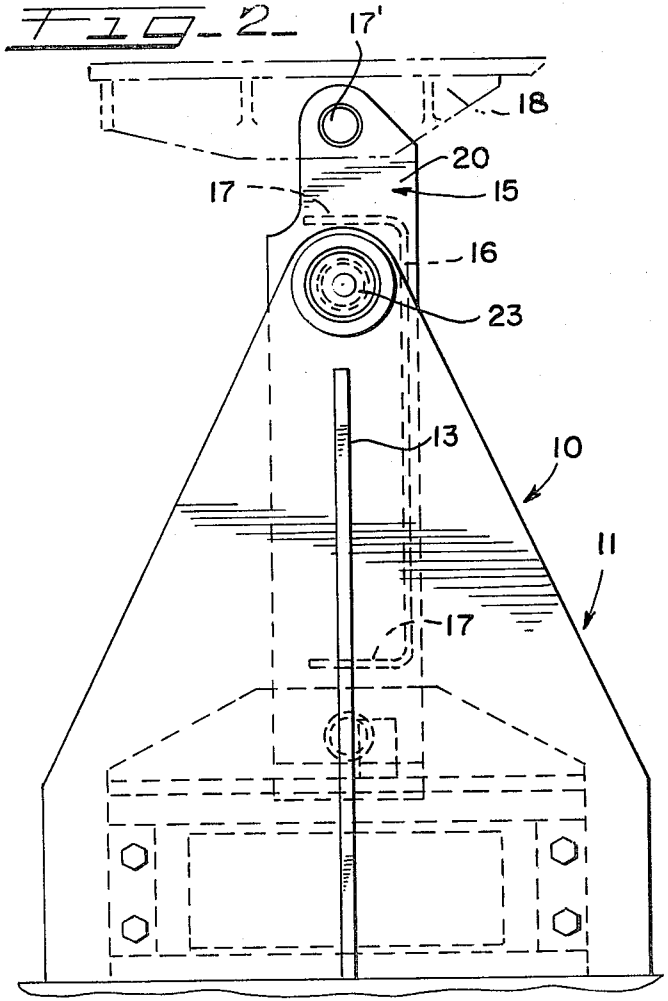
FIG. 2 is a side elevational view of the hitch disclosed in FIG. 1.
Figure 5:
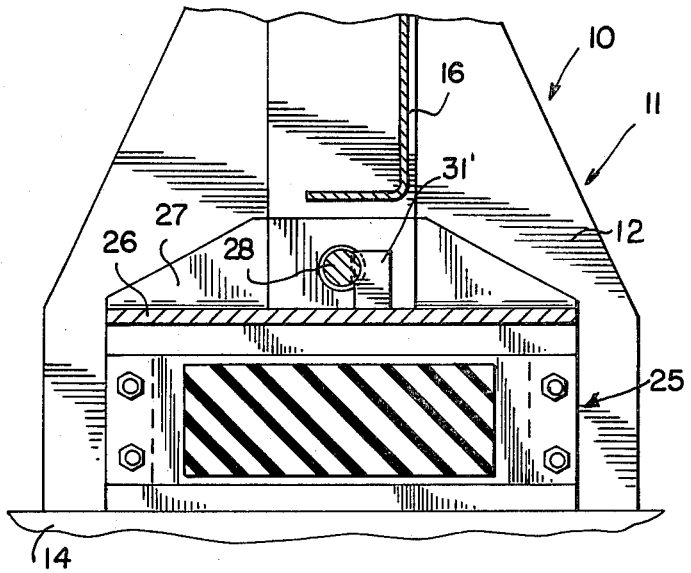

Referring particularly to FIGS. 1, 2, and 3, a trailer hitch is generally designated by the reference character 10 and includes a pedestal 11 comprising spaced upright plates 12 including gussets 13 which are rigidly welded to a platform 14 which may be part of any transportation device or storage area whenever the hitch is to be utilized. A pair of vertical fifth wheel support members 15 are interconnected by a transversely extending plate 16 which includes horizontal flanges 17. The upper ends of the support members 15 include aligned bores 16' which by means of pivot pins 17' support a conventional fifth wheel plate 18 shown schematically and having the usual gathering jaw 19 for engaging and securing a trailer king pin (not shown) of an over-the-highway trailer.

Each support member 15 includes an upper portion 20 and lower depending portion 21. The support members 15 include aligned openings 22 which support a pivot shaft 23 also supported in aligned openings 24 of the upright plates 12.

Figure 6:
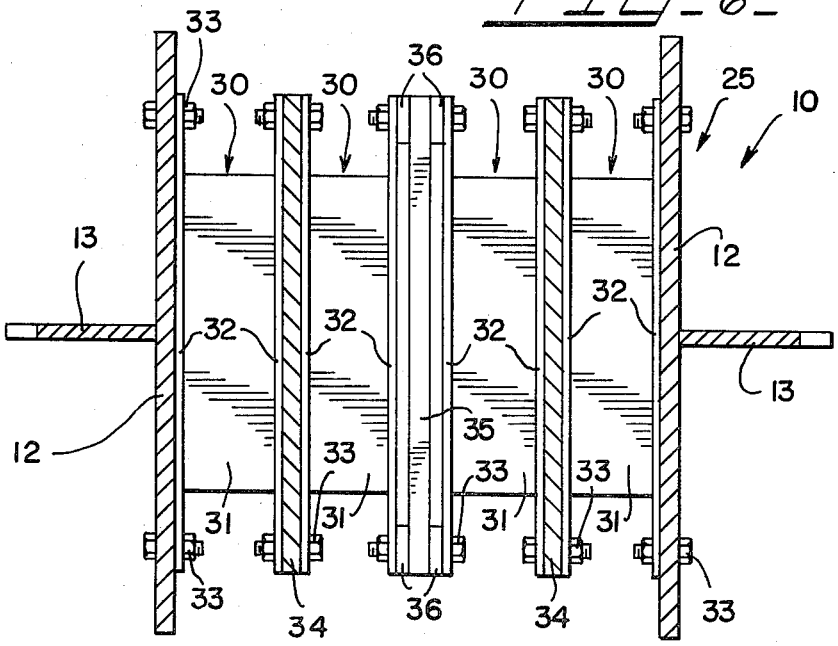
FIG. 6 is a cross-sectional view taken along the line 6—6 of FIG. 3.

A cushioning arrangement is generally designated by the reference character 25 and includes a flat plate or shoe 26 having vertical flanges 27. A pivot shaft 28 is supported for rotation in openings 29 of the upright supports 12. Support blocks 30' are welded to the flanges 27 and further strengthen the shaft 28. The shaft 28 is secured against rotation by means of a bracket 31' suitably welded to the shaft 28 and shoe 26. Shock absorbing units 30 each include a resilient block 31 which is bonded to parallel plates 32. The outer units 30 are secured by fasteners 33 to the pedestal plates 12 and to vertical plates 34 having their upper edges welded to the underneath portion of the shoe 26. Inner units 30 have their plates 32 secured to the plates 34 projecting downwardly from the shoe 26 and also have plates 32 connected to an anchoring plate or member 35 welded to the platform 14. The fasteners 33 of the inner units 30 secure the units to the anchoring plate 35 by means of spacers 36 as indicated in FIG. 6.

Operation

As conventional in the art of trailer hitches the present hitch includes a fifth wheel structure to which the over-the-highway trailer is attached. The hitch may be utilized on railway cars, ships, barges, or it may be utilized in storage yards for temporarily supporting stored trailers. In the present design, unlike other hitches, the hitch is not designed for collapse as may be the case in flat car operation on railroads wherein circus loading and pull up hitches are required.

In the hitch disclosed the trailer may be secured to the top plate of the hitch in conventional fashion. In the event of shocks as would occur during transport of the trailers, the shock would cause swinging movement of the support members on the pedestal resulting in longitudinal movement of the shoe 26. The shocks would be absorbed by the cushion 30 which are placed in shear tension by the relative movement of the shoe and plates 34 and the stationary anchoring of the plate 35 and the pedestal sides 12. Thus effective cushioning action is achieved by the arrangement disclosed.

The foregoing description and drawings merely explain and illustrate the invention and the invention is not limited thereto, except insofar as the appended claims are so limited, as those skilled in the art who have the disclosure before them will be able to make modification and variations therein without departing from the scope of the invention.

What is claimed is:

1. In a trailer hitch comprising an upright pedestal, a platform for supporting said pedestal, a generally vertical fifth wheel support member, means pivotally supporting said generally vertical fifth wheel support member on said pedestal for swinging movement about a horizontal axis, said generally vertical fifth wheel support member including an upper portion disposed above said pivotal means and a lower portion disposed below said pivotal means, the improvement comprising a cushioning assembly including a generally horizontal plate, means pivotally connecting said plate to the lower portion of said support member, first vertical plate means connected to said horizontal plate and depending therefrom, second vertical plate means supported on said platform and projecting upwardly therefrom, and shock absorbing means interconnecting said first and second plate means.

2. The improvement in accordance with claim 1, said generally horizontal plate including laterally spaced upwardly extending flanges, a pivot shaft supported on said flanges, and means pivotally supporting said pivot shaft on said generally vertical fifth wheel support member.

3. The improvement in accordance with claim 2, including anchoring means connected to said horizontal plate and said shaft for restraining said shaft against rotation.

4. The improvement in accordance with claim 1, said shock absorbing means including resilient elements connected to said first and second plate means.

5. The improvement in accordance with claim 4, said second vertical plate means being centrally supported on said platform between said first vertical plate means.

6. The improvement in accordance with claim 5, said resilient elements being connected to said upright pedestal.

7. The improvement in accordance with claim 3, said anchoring means including a vertical bracket rigidly connected to said shaft and said horizontal plate.

8. The improvement in accordance with claim 7, said pedestal including spaced-apart upright members rigidly connected to said platform, and said pivotal means of said support member being connected to the upper ends of said upright members.

9. The improvement in accordance with claim 8, said support member including a pair of laterally upright beam members and a vertical connector plate connecting said beam members.

10. The improvement in accordance with claim 9, said shock absorbing means including a plurality of resilient shear blocks connecting said horizontal plate and said platform for cushioning shocks administered to said trailer hitch.

* * * * *